US010804046B2

(12) United States Patent
Liu et al.

(10) Patent No.: US 10,804,046 B2
(45) Date of Patent: Oct. 13, 2020

(54) KEY STRUCTURE AND ELECTRONIC APPARATUS

(71) Applicant: Beijing Xiaomi Mobile Software Co., Ltd., Beijing (CN)

(72) Inventors: Jianwei Liu, Beijing (CN); Shaojie Wang, Beijing (CN); Jianjun Zhang, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/173,921

(22) Filed: Oct. 29, 2018

(65) Prior Publication Data

US 2019/0131084 A1 May 2, 2019

(30) Foreign Application Priority Data

Oct. 30, 2017 (CN) ..... 2017 1 1037934

(51) Int. Cl.
*H01H 13/14* (2006.01)
*H01H 13/04* (2006.01)
(Continued)

(52) U.S. Cl.
CPC ..... *H01H 13/04* (2013.01); *H01H 13/86* (2013.01); *H01H 21/24* (2013.01); *H01H 2221/016* (2013.01); *H01H 2231/022* (2013.01)

(58) Field of Classification Search
CPC .. H01H 2221/016; H01H 21/22; H01H 21/24; H01H 13/50; H01H 3/122;
(Continued)

(56) References Cited

U.S. PATENT DOCUMENTS 5,760,356 A * 6/1998 Garcia ..... H01H 13/06 200/302.1
7,381,919 B1 * 6/2008 Yu ..... H01H 21/24 200/296
(Continued)

FOREIGN PATENT DOCUMENTS

CN 2560080 Y 7/2003
CN 105118716 A 12/2015
(Continued)

OTHER PUBLICATIONS

Extended European Search Report dated Jan. 4, 2019 in European Patent Application No. 18203151.8, 7 pages.
(Continued)

*Primary Examiner* — Ahmed M Saeed
(74) *Attorney, Agent, or Firm* — Oblon, McClelland, Maier & Neustadt, L.L.P.

(57) ABSTRACT

The present disclosure relates to a key structure and an electronic apparatus. The key structure includes a housing; an electronic switch; a key cap; and a rocker, wherein the housing is provided with an opening configured to mount the key cap, the electronic switch is located inside the housing and corresponds to a position of the opening, and the key cap is mounted in the opening, and wherein the rocker has a first end fixed to the key cap and a second end hinged to the housing, and the rocker has a length larger than or equal to a first predetermined value.

18 Claims, 5 Drawing Sheets

(51) Int. Cl.
*H01H 21/24* (2006.01)
*H01H 13/86* (2006.01)

(58) Field of Classification Search
CPC .... H01H 13/7006; H01H 13/04; H01H 13/86; H01H 2231/022; H01H 13/14; H01H 23/30; H01H 23/143; H01H 2021/225; H01H 19/635; H01H 23/145; H01H 2300/01; H01H 23/24; H01H 25/041; H01H 2003/0273
See application file for complete search history.

(56) References Cited

U.S. PATENT DOCUMENTS

2006/0076222 A1 4/2006 Lin et al.
2012/0043191 A1* 2/2012 Kessler ..... H01H 3/125 200/5 A

FOREIGN PATENT DOCUMENTS

| | | | |
|---|---|---|---|
| CN | 205071109 | U | 3/2016 |
| CN | 205354927 | U | 6/2016 |
| CN | 206059243 | U | 3/2017 |
| CN | 207338194 | U | 5/2018 |
| JP | 2-247922 | A | 10/1990 |

OTHER PUBLICATIONS

Combined Chinese Office Action and Search Report dated Jul. 3, 2019 in Patent Application No. 201711037934.2 (with partial English translation and English translation of categories of cited documents), 13 pages.

* cited by examiner

KEY STRUCTURE AND ELECTRONIC APPARATUS

CROSS-REFERENCE TO RELATED APPLICATIONS

This application is based on and claims priority to Chinese Patent Application Serial No. 201711037934.2, filed with the State Intellectual Property Office of P. R. China on Oct. 30, 2017, the entire contents of which are incorporated herein by reference.

TECHNICAL FIELD

The present disclosure relates to a field of electronic technology, and more particularly to a key structure and an electronic apparatus.

BACKGROUND

It is common for an electronic apparatus, such as a smart phone, to have a key structure that is configured to act as a functional switch (e.g., on/off button, volume button, etc.).

The key structure typically exhibits a relatively high utilization frequency. A key cap of the key structure tends to tilt and shake in an opening especially when the user presses the key cap with an uneven force. The key cap rubs against a side wall of the opening frequently, which causes worse wearing of the key cap. Furthermore, the gap between the key cap and the housing enlarges, causing the key cap to sink and/or be stuck, thus resulting in failure of normal use of the key structure.

SUMMARY

This Summary is provided to introduce a selection of aspects of the present disclosure in a simplified form that are further described below in the Detailed Description. This Summary is not intended to identify key features or essential features of the claimed subject matter, nor is it intended to be used to limit the scope of the claimed subject matter.

Aspects of the disclosure provide a key structure that includes a housing; an electronic switch; a key cap; and a rocker, wherein the housing is provided with an opening configured to mount the key cap, the electronic switch is located inside the housing and corresponds to a position of the opening, and the key cap is mounted in the opening, and wherein the rocker has a first end fixed to the key cap and a second end hinged to the housing, and the rocker has a length larger than or equal to a first predetermined value.

According to an aspect, the second end of the rocker away from the key cap is provided with a first rotation shaft, the housing is provided with a mounting hole corresponding to the first rotation shaft, and the first rotation shaft is mounted into the mounting hole.

According to another aspect, the second end of the rocker away from the key cap is provided with a mounting hole, the housing is provided with a second rotation shaft corresponding to the mounting hole, and the second rotation shaft is mounted into the mounting hole.

According to yet another aspect, the key cap and the rocker are formed integrally.

In another example, the housing is provided with a strip groove and the rocker is located in the strip groove.

According to yet another aspect, when the key cap is in an un-pressed state, the rocker is perpendicular to a press direction of the electronic switch.

In an example, the first predetermined value is 30 mm.

Aspects of the disclosure also provide an electronic apparatus that includes the key structure, where the housing of the key structure is a housing of the electronic apparatus.

It is to be understood that both the foregoing general description and the following detailed description are illustrative and explanatory only and are not restrictive of the present disclosure.

BRIEF DESCRIPTION OF THE DRAWINGS

The accompanying drawings, which are incorporated in and constitute a part of this specification, illustrate aspects consistent with the present disclosure and together with the description, serve to explain the principles of the disclosure.

The specific aspects of the present disclosure, which have been illustrated by the accompanying drawings described above, will be described in detail below. These accompanying drawings and description are not intended to limit the scope of the present disclosure in any manner, but to explain the concept of the present disclosure to those skilled in the art via referencing specific aspects.

DETAILED DESCRIPTION

Reference will now be made in detail to exemplary aspects, examples of which are illustrated in the accompanying drawings. The following description refers to the accompanying drawings in which the same numbers in different drawings represent the same or similar elements unless otherwise represented. The implementations set forth in the following description of illustrative aspects do not represent all implementations consistent with the disclosure. Instead, they are merely examples of apparatuses and methods consistent with aspects related to the disclosure as recited in the appended claims.

The present aspect discloses a key structure, which can be applied to an electronic apparatus, and the electronic apparatus can be various mobile terminals such as a mobile phone, a tablet computer and the like.

Figure 1:
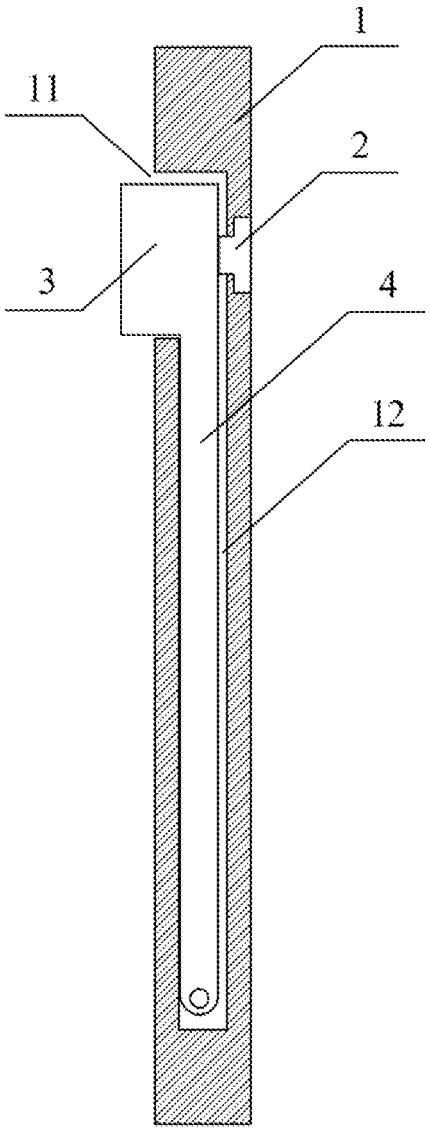
FIG. 1 is a schematic view of a key structure illustrated according to an exemplary aspect of the present disclosure.

As illustrated in FIG. 1, the key structure includes a housing 1, an electronic switch 2, a key cap 3 and a rocker 4. The housing 1 is provided with an opening 11 configured for the key cap 3 to be mounted, the electronic switch 2 is located inside the housing 1 and aligned with a position of the opening 11, and the key cap 3 is mounted in the opening 11. The rocker 4 has a first end fixed to the key cap 3 and a second end hinged to the housing 1. The rocker 4 has a length larger than a first predetermined value.

The key structure is namely a structure mounted to the electronic apparatus and configured to perform functions, such as switching. For example, a power key and a volume key in a side portion of the mobile phone are key structures, which are mounted in and in clearance fit with the housing of the mobile phone.

In the aspects, the key structure can be mounted in the electronic apparatus as an independent component or be used cooperatively with other components of the electronic apparatus. In most cases, the key structure is used cooperatively with other components of the electronic apparatus, and in these cases, the housing 1 is a housing of the electronic apparatus. The electronic switch 2 is mounted inside the housing 1, and the electronic switch 2 is an element having a switch function and constituted by a metal dome and a circuit board. The housing 1 is provided with the opening 11 in the position corresponding to the electronic switch 2, the key cap 3 configured to press and protect the electronic switch 2 is mounted in the opening 11, and an end face of the key cap 3 away from the electronic switch 2 protrudes from the opening 11 mainly for convenience of being pressed by the user. The key cap 3 is generally in clearance fit with the housing 1, that is, the periphery size of the key cap 3 is smaller than the size of the opening 11.

In practical applications, the key structure exhibits a relatively high utilization frequency. The key cap 3 tends to tilt and shake in the opening 11 especially when the user presses the key cap 3 with an uneven force, so that friction of the key cap 3 against an inner wall of the opening 11 causes worse wearing of the key cap 3, and further the gap between the key cap 3 and the housing 1 enlarges, such that situations that for example the key cap 3 tends to sink and be stuck occur, causing failure of normal use of the key structure.

Aiming at the above-mentioned problems, the key structure in the present aspect further includes the rocker 4. The rocker 4 has a first end fixed to the key cap 3 and a second end hinged to the housing 1. The rocker 4 has a length larger than the first predetermined value. As illustrated in FIG. 1, when a user presses the key cap 3, the key cap 3 and the rocker 4 rotate as a whole about the hinged position of the rocker 4 and the housing 1. Generally, the key cap 3 has a relatively short movement displacement and a relatively long distance from the hinged position of the rocker 4 and the housing 1, in which way, the key cap 3 can be regarded as moving horizontally along an original pressing direction, that is, the key cap 3 basically doesn't tilt or tilts for a very small angle in the opening 11, which prevents the key cap 3 from shaking in the opening 11. Thus, it is possible to prevent a situation that wearing of the key cap 3 causes the gap between the key cap 3 and the housing 1 to enlarge and hence the key cap 3 is stuck to result in failure of normal use of the key structure.

Optionally, according to theoretical calculation and a plurality of tests, a minimum value of the length of the rocker 4 is 30 mm. When the length of the rocker 4 is larger than or equal to 30 mm, it is more effective to prevent the key cap 3 from tilting in the opening 11 and being worn.

Optionally, the key cap 3 and the rocker 4 can be connected with a bolt or a pin, and this kind of connection manner facilities the assembly of the key structure. For example, in the assembling process of the key structure, the key cap 3 and the rocker 4 can be mounted separately. As illustrated in FIG. 1, the key cap 3 and the rocker 4 can also be formed integrally. The number of parts of the key structure can be reduced by integral forming, which prevents situations that too many parts exist in the assembling process and are lost.

Optionally, the rocker 4 is located inside the housing 1. In order to stabilize the rocker 4, as illustrated in FIG. 1, the corresponding structure can be such that the housing 1 is provided with a strip groove 12 and the rocker 4 is located in the strip groove 12.

In the aspects, the strip groove 12 has a shape and size in match with a shape and size of the rocker 4. Specifically, for example, the shape of the rocker 4 can be a flat rectangle, and the shape of the strip groove 12 can be a strip-shaped rectangular groove, and a groove width of the strip groove 12, i.e. the width of the rectangle, is larger than a width of the rocker 4 so that the rocker 4 can rotate in the strip groove 12 for a small angle.

Optionally, in order to stabilize the rocker 4 in the strip groove 12, the corresponding structure can be such that a side of the rocker 4 away from the electronic switch 2 and the strip groove 12 are fitted together, and hence, as illustrated in FIG. 1, the key cap 3 and the rocker 4 are clamped in the housing 1 by means of the strip groove 12 and the electronic switch 2 so as to be prevented from tilting or shaking in the housing 1.

In applications, in order not to influence the normal operation of the key structure, the size of the opening 11 in the housing 1 is required to meet the two conditions as follows. Firstly, when the user presses the key cap 3, a perpendicular distance between the key cap 3 and a side wall of the opening 11 away from the strip groove 12 is larger than zero, and the electronic switch 2 can be triggered exactly when the perpendicular distance is zero. Secondly, when the user presses the key cap 3, on the premise of meeting the first condition where the perpendicular distance between the key cap 3 and the side wall of the opening 11 away from the strip groove 12 is larger than zero, when the electronic switch 2 is pressed up to the highest degree, a perpendicular distance between the key cap 3 and a bottom of the opening 11 is larger than or equal to zero.

Figure 2:
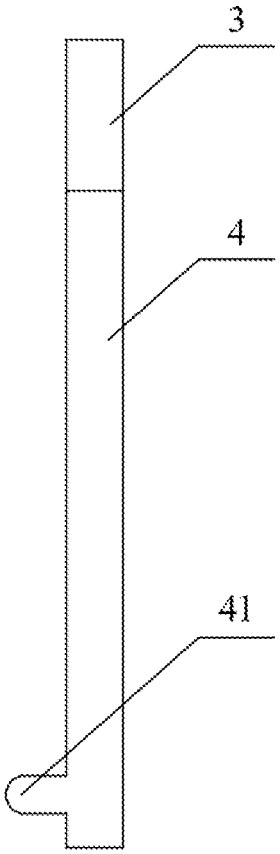
FIG. 2 is a schematic view of a rocker illustrated according to an exemplary aspect of the present disclosure.
Figure 3:
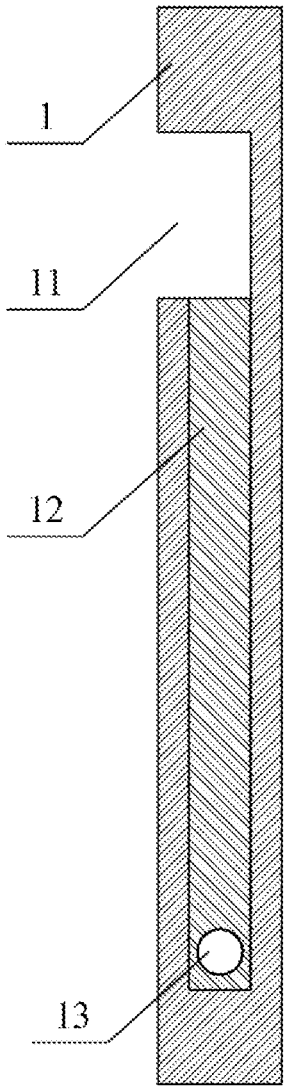
FIG. 3 is a schematic view of a housing of a key structure illustrated according to an exemplary aspect of the present disclosure.

Optionally, a hinge joint between the rocker 4 and the housing 1 can be achieved by a rotation shaft and a mounting hole configured for the rotation shaft to be mounted, and the corresponding structure can be such that the second end of the rocker 4 away from the key cap 3 is provided with a first rotation shaft 41, as illustrated in FIG. 2, and the housing 1 is provided with a mounting hole 13 corresponding to the first rotation shaft 41, the first rotation shaft 41 being mounted into the mounting hole 13, as illustrated in FIG. 3.

Figure 4:
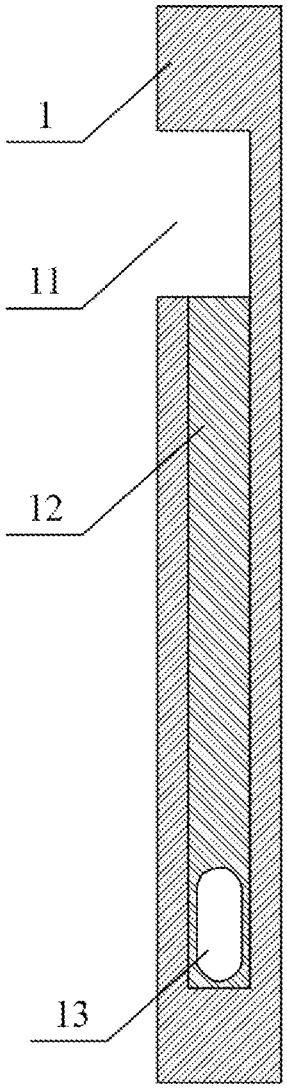
FIG. 4 is a schematic view of a housing of a key structure illustrated according to an exemplary aspect of the present disclosure.

In practical applications, the first rotation shaft 41 is mostly cylindrical so as to rotate conveniently, and a section shape of the mounting hole 13 can be a circular hole in match with a shape of the first rotation shaft 41. The section of the mounting hole 13 can also be in an elongated shape, and specifically, as illustrated in FIG. 4, the section of the mounting hole 13 can be in the elongated shape with two arc-shaped ends and a rectangular middle part, the elongated shape is parallel with the rocker 4, the rocker 4 is located in the mounting hole 13 of the elongated shape and fits to the arc-shaped parts of the mounting hole 13. The shape of the mounting hole 13 can be configured in any manner on condition that the first rotation shaft 41 can be mounted in the mounting hole 13 and the first rotation shaft 41 is allowed to rotate, which is not specifically limited in the present aspect.

Figure 5:
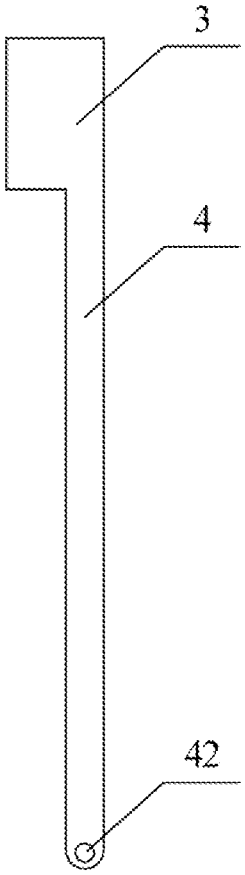
FIG. 5 is a schematic view of a rocker illustrated according to an exemplary aspect of the present disclosure.

Optionally, the hinge connection between the rocker 4 and the housing 1 can also be configured in the following way. As illustrated in FIG. 5, the second end of the rocker 4 away from the key cap 3 is provided with the mounting hole 42, the housing 1 is provided with the second rotation shaft corresponding to the mounting hole 42, the second rotation shaft is mounted into the mounting hole 42, and the second rotation shaft is similar to the first rotation shaft 41.

The shape of the second rotation shaft can be cylindrical correspondingly to the mounting hole 42. This way of hinge joint between the rocker 4 and the housing 1 has the same principle as the above-mentioned way of hinge joint, both of which rely on the rotation of the rotation shaft in the mounting hole, and the difference is the arranged positions of the rotation shaft and the mounting hole. In the present aspect, the hinge joint between the rocker 4 and the housing 1 is mainly to enable the key cap 3 to rotate about the hinged position, and the specific implementation manner is not limited in the present aspect.

Optionally, as illustrated in FIG. 1, when the key cap 3 is in an un-pressed state, the rocker 4 is perpendicular to a press direction of the electronic switch 2. Certainly, when the key cap 3 is in the un-pressed state, the rocker 4 can also be in an included angle of a predetermined degree with respect to the press direction of the electronic switch 2, and the predetermined degree is close to 90 degrees.

In aspects of the present disclosure, the key structure includes not only the housing, the electronic switch and the key cap, but also the rocker. The housing is provided with the opening configured for the key cap to be mounted, the electronic switch is located inside the housing and aligned with the position of the opening, and the key cap is mounted in the opening. The rocker has the first end fixed to the key cap and the second end hinged to the housing. The rocker has the length larger than the predetermined value. In such a way, when the user presses the key cap, the key cap and the rocker rotate as a whole about the hinged position of the rocker and the housing. Because the key cap has the relatively short movement displacement and the relatively long distance from the hinged position of the rocker and the housing, the key cap basically doesn't tilt or tilts for the very small angle in the opening, and hence the key cap basically doesn't rub against the inner wall of the opening. Based on the above-mentioned structure, a movement track of the key cap in opening can be controlled by designing the size of parts, so that wearing of the key cap can be avoided and further the situation that the gap between the key cap and the housing is enlarged to cause the shake of the key cap in the opening and make it impossible for the key structure to be operated normally can be prevented.

The present disclosure further illustrates the electronic apparatus, the electronic apparatus includes the housing and the above-mentioned key structure, and the key structure is mounted in the housing of the electronic apparatus. The key structure can serve as an independent component and be mounted in the electronic apparatus, and can also be used cooperatively with other components of the electronic apparatus. In most cases, the key structure and the housing of the electronic apparatus are used cooperatively, and in these cases, the housing of the electronic apparatus is namely the housing of the key structure.

In aspects of the present disclosure, the key structure in the electronic apparatus includes not only the housing, the electronic switch and the key cap, but also the rocker, as described above. The housing is provided with the opening configured for the key cap to be mounted, the electronic switch is located inside the housing and aligned with the position of the opening, and the key cap is mounted in the opening. The rocker has the first end fixed to the key cap and the second end hinged to the housing. The rocker has the length larger than the predetermined value. In such a way, when the user presses the key cap, the key cap and the rocker rotate as a whole about the hinged position of the rocker and the housing. Because the key cap has the relatively short movement displacement and the relatively long distance from the hinged position of the rocker and the housing, the key cap basically doesn't tilt or tilts for the very small angle in the opening, and hence the key cap basically doesn't rub against the inner wall of the opening. Based on the above-mentioned structure, the movement track of the key cap in opening can be controlled by designing the size of parts, so that wearing of the key cap can be avoided and further the situation that the gap between the key cap and the housing is enlarged to cause the shake of the key cap in the opening and make it impossible for the key structure to be operated normally can be prevented.

Other aspects of the present disclosure will be readily devised by those of skill in the art upon consideration of the specification and practice of the disclosure disclosed herein. The application is intended to cover any variations, uses or adaptive change of the disclosure, and the variations, uses or adaptive change follow the general principles of the present disclosure and include common knowledge or customary techniques in the art which are not disclosed in the present disclosure. The specification and aspects are to be regarded only as illustrative and the true scope and spirit of the present disclosure is defined by the above claims.

It is to be understood that the present disclosure is not limited to the precise structures that have been described above and shown in the accompanying drawings and that various modifications and changes can be made without departing from the scope thereof. The scope of the present disclosure is limited only by the appended claims.

What is claimed is:

1. A key structure, comprising:

a housing;

an electronic switch;

a key cap; and a rocker, wherein the housing is provided with an opening configured to mount the key cap, the electronic switch is located inside the housing and corresponds to a position of the opening, and the key cap is mounted in the opening, wherein the rocker has a first end fixed to the key cap and a second end hinged to the housing, and the rocker has a length larger than or equal to a first predetermined value, wherein the housing is provided with a strip groove and the rocker is located in the strip groove, wherein in an axis direction of the opening, a wall of the strip groove facing the electronic switch is a flat wall, a wall of the rocker facing away from the electronic switch is a flat wall, the flat wall of the strip groove and the flat wall of the rocker are fitted together with no gap therebetween when the key cap is in an un-pressed state, and the key cap and the rocker are clamped in the housing by means of the strip groove and the electronic switch, and wherein the length of the rocker is parallel to a length of the strip groove, and the length of the strip groove is greater than or equal to the length of the rocker.

2. The key structure according to claim 1, wherein the second end of the rocker away from the key cap is provided with a first rotation shaft, the housing is provided with a mounting hole corresponding to the first rotation shaft, and the first rotation shaft is mounted into the mounting hole.

3. The key structure according to claim 1, wherein the second end of the rocker away from the key cap is provided with a mounting hole, the housing is provided with a second rotation shaft corresponding to the mounting hole, and the second rotation shaft is mounted into the mounting hole.

4. The key structure according to claim 1, wherein the key cap and the rocker are formed integrally.

5. The key structure according to claim 1, wherein when the key cap is in the un-pressed state, the rocker is perpendicular to a press direction of the electronic switch.

6. The key structure according to claim 1, wherein the first predetermined value is 30 mm.

7. The key structure according to claim 2, wherein the first predetermined value is 30 mm.

8. The key structure according to claim 3, wherein the first predetermined value is 30 mm.

9. The key structure according to claim 4, wherein the first predetermined value is 30 mm.

10. The key structure according to claim 5, wherein the first predetermined value is 30 mm.

11. An electronic apparatus, comprising:

a key structure that includes:

a housing;

an electronic switch;

a key cap; and a rocker, wherein the housing is provided with an opening configured to mount the key cap, the electronic switch is located inside the housing and corresponds to a position of the opening, and the key cap is mounted in the opening, wherein the rocker has a first end fixed to the key cap and a second end hinged to the housing, the rocker has a length larger than or equal to a first predetermined value, and the housing of the key structure is a housing of the electronic apparatus, wherein the housing is provided with a strip groove and the rocker is located in the strip groove, wherein in an axis direction of the opening, a wall of the strip groove facing the electronic switch is a flat wall, a wall of the rocker facing away from the electronic switch is a flat wall, the flat wall of the strip groove and the flat wall of the rocker are fitted together with no gap therebetween when the key cap is in an un-pressed state, and the key cap and the rocker are clamped in the housing by means of the strip groove and the electronic switch, and wherein the length of the rocker is parallel to a length of the strip groove, and the length of the strip groove is greater than or equal to the length of the rocker.

12. The electronic apparatus according to claim 11, wherein the second end of the rocker away from the key cap is provided with a first rotation shaft, the housing is provided with a mounting hole corresponding to the first rotation shaft, and the first rotation shaft is mounted into the mounting hole.

13. The electronic apparatus according to claim 11, wherein the second end of the rocker away from the key cap is provided with a mounting hole, the housing is provided with a second rotation shaft corresponding to the mounting hole, and the second rotation shaft is mounted into the mounting hole.

14. The electronic apparatus according to claim 11, wherein the key cap and the rocker are formed integrally.

15. The electronic apparatus according to claim 11, wherein when the key cap is in an un-pressed state, the rocker is perpendicular to a press direction of the electronic switch.

16. The electronic apparatus according to claim 11, wherein the first predetermined value is 30 mm.

17. The electronic apparatus according to claim 12, wherein the first predetermined value is 30 mm.

18. The key structure according to claim 1, wherein a shape of the rocker is a flat rectangle, and a shape of the strip groove is a strip-shaped rectangular groove.

* * * * *